US012571564B2

(12) United States Patent
Ma et al.

(10) Patent No.: US 12,571,564 B2
(45) Date of Patent: Mar. 10, 2026

(54) HIGH-EFFICIENT INTEGRATED COMPRESSOR-EJECTOR-OHP HEAT PUMP

(71) Applicant: THE CURATORS OF THE UNIVERSITY OF MISSOURI, Columbia, MO (US)

(72) Inventors: Hongbin Ma, Columbia, MO (US); Ramy Abdelhady, Columbia, MO (US)

(73) Assignee: THE CURATORS OF THE UNIVERSITY OF MISSOURI, Columbia, MO (US)

( * ) Notice: Subject to any disclaimer, the term of this patent is extended or adjusted under 35 U.S.C. 154(b) by 175 days.

(21) Appl. No.: 18/467,409

(22) Filed: Sep. 14, 2023

(65) Prior Publication Data

US 2024/0118001 A1 Apr. 11, 2024

Related U.S. Application Data

(60) Provisional application No. 63/377,828, filed on Sep. 30, 2022.

(51) Int. Cl.

| | |
|---|---|
| ***F25B 1/08*** | (2006.01) |
| ***F25B 5/02*** | (2006.01) |
| ***F25B 41/22*** | (2021.01) |

(52) U.S. Cl.

CPC ..... *F25B 1/08* (2013.01); *F25B 5/02* (2013.01); *F25B 41/22* (2021.01)

(58) Field of Classification Search

CPC .... F25B 5/02; F25B 41/22; F25B 2341/0014; F25B 2341/0012; F25B 2341/001; F25B 2341/00; F25B 9/08; F25B 1/08

See application file for complete search history.

(56) References Cited

U.S. PATENT DOCUMENTS 2,912,831 A * 11/1959 Palmatier ..... F25B 41/00 62/DIG. 17

FOREIGN PATENT DOCUMENTS

CN 201589459 U * 9/2010
CN 111174453 A * 5/2020 ..... F25B 1/08

* cited by examiner

*Primary Examiner* — Miguel A Diaz

(74) *Attorney, Agent, or Firm* — McKee, Voorhees & Sease, PLC

(57) ABSTRACT

A heat pump system and method of use are disclosed for cooling or heating utilizing a refrigerant that includes a compressor, an ejector in fluid communication with an output of the compressor, a condenser in fluid communication with an output of the ejector, a throttling valve in fluid communication with an output of the condenser. An evaporator having an input in fluid communication with an output of the throttling valve and an output in fluid communication with an input of the ejector and an input of the compressor. There is also disclosed for data centers, a combination evaporator-OHPs and the second plurality of combination evaporator-ejector OHPs for cooling a plurality of servers where the first plurality of combination evaporator-OHPs and the second plurality of combination evaporator-ejector OHPs each include an adjacent wicking structure that is adjacent to a vapor channel and a liquid channel.

19 Claims, 4 Drawing Sheets

Section A-A

HIGH-EFFICIENT INTEGRATED COMPRESSOR-EJECTOR-OHP HEAT PUMP

CROSS REFERENCE TO RELATED APPLICATIONS

This application claims priority under 35 U.S.C. § 119 to provisional patent application U.S. Ser. No. 63/377,828, filed Sep. 30, 2022. The provisional patent application is herein incorporated by reference in its entirety, including without limitation, the specification, claims, and abstract, as well as any figures, tables, appendices, or drawings thereof.

STATEMENT REGARDING FEDERALLY SPONSORED RESEARCH OR DEVELOPMENT

This invention was made with government support under grant number DE-AC05-000R22725 awarded by the U.S. Department of Energy. The government has certain rights in the invention.

TECHNICAL FIELD

The present invention addresses the numerous disadvantages related to the vapor compression cycle ("VCC") and ejector refrigeration cycle ("ERC"). It is a combined heat pump system that integrates state-of-the-art technologies of the ERC, VCC, and Oscillating Heat Pipes ("OHPs") to solve the high energy consumption associated with traditional heat pumps. Thus, the objective of the present invention is to develop a heat pump (a machine that could produce both cooling or heating energy) that could cut down energy consumption and operate reliably over a wide range of operating conditions.

BACKGROUND

The background description provided herein gives context for the present disclosure. Work of the presently named inventors, as well as aspects of the description that may not otherwise qualify as prior art at the time of filing, are neither expressly nor impliedly admitted as prior art.

Cooling and heating of buildings represent 36% of the energy consumption of the building sector, indicating a necessity for improving the performance of cooling and heating devices. The vapor compression cycle (VCC) (electrically driven heat pump) is the dominant, well-established, and mature technology that is used as a conventional air conditioning (AC) system to provide cooling or heating energy for buildings. The basic cycle consists of an evaporator, condenser, expansion device, and electricity-driven compressor. For cooling applications, the evaporator of VCC operates at about 5° C. (evaporator surface temperature), and a fan is used to draw the indoor air over its surface to be cooled and dehumidified, i.e., remove sensible and latent heat. So, the VCC handles the sensible and latent heat of the space simultaneously. This requires air to be cooled below its dew point temperature, resulting in low energy efficiency, particularly at low sensible heat ratios where sensible load is much less than latent load. This means that much energy consumed in VCC is not utilized efficiently, making the VCC an energy-intensive technology. Furthermore, conventional AC may be unable to simultaneously control the indoor temperature and humidity. Therefore, decoupling the sensible and latent loads can improve the performance of VCC.

Referring now to FIG. 1, the current conventional air conditioning (AC) system is generally indicated by the numeral 10. While the surface temperature is about 5° C. of the evaporator 12, the air 18 entering the evaporator 12 is cooled 14 and typically leaves the evaporator 12 at a temperature of about 12-15° C. If air 14 is utilized to cool down servers or CPUs 16 in data centers, it will exchange heat with the CPUs to keep their temperatures around 30-40° C. while heating the air 24. So, the VCC produces cooling energy at 5° C. to keep the temperature of CPUs 16 at 40° C. The temperature difference between the CPUs 16 and the surface temperature of the evaporator 12 is due to the convective heat resistance between the evaporator 12 and air (R1) 20 and between the air 14 and CPUs (R2) 22. This also contributes to high energy consumption in AC used for data centers.

On the other hand, the ejector refrigeration cycle (ERC) was developed and used for cooling and heating applications to replace the VCC. The cycle is thermally driven, so no electricity is needed to supply power. However, this cycle has low efficiency and is sensitive to ambient and operation conditions.

SUMMARY

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the present disclosure to improve on or overcome the deficiencies in the art.

A feature of the present disclosure is a combined heat pump system that integrates state-of-the-art technologies of the ejector refrigeration cycle, vapor compression cycle, and Oscillating Heat Pipes (OHP) is disclosed to solve the high energy consumption associated with traditional heat pumps.

The invented heat pump consists of a compressor, evaporators coupled with OHPs, a condenser, and an ejector. It has two evaporators; one is connected to a compressor, and another one is linked to an ejector, allowing the cooling energy to be provided at two different temperatures based on the applications and the needed thermal load of space. This arrangement enables the system to work with a single or binary fluid. The combined system is used for cooling or heating residential or industrial buildings. It is also used for cooling data centers.

The novel aspects of the invention are using an electrical compressor and an ejector as a combined electrical-thermal compressor to circulate the working fluid around the cycle and pump the heat from low-temperature reservoirs to a high-temperature reservoir. The concept of an electrical thermal compressor reduces the compression power by several folds, and hence high performance is attained. Also, integrating OHP with an evaporator eliminates the convective heat transfer resistance between the indoor air and the evaporator's surface.

Moreover, the combined system has a feature to operate using binary fluid, which is selected based on the ambient conditions of the location where the system is installed. This feature allows the system to work at high performance regardless of the local climate conditions. This invention reduces energy consumption by at least a factor of three compared to the traditional heat pump. Energy saving associated with the invented system could be further improved by optimizing the design of ejector geometry according to the operating working fluid.

The main feature of the present disclosure is the coupling between the compressor and ejector to power the heat pump and save energy consumption. Different arrangements from the presently invented heat pump are disclosed and adapted based on the application to achieve high performance at various operating conditions.

A combined heat pump system that integrates state-of-the-art technologies of the ejector refrigeration cycle, vapor compression cycle, and Oscillating Heat Pipes (OHP) is disclosed to solve the high energy consumption associated with traditional heat pumps. The invented heat pump consists of a compressor, evaporators coupled with OHPs, a condenser, and an ejector. It has two evaporators; one is connected to a compressor, and another one is linked to an ejector, allowing the cooling energy to be provided at two different temperatures based on the applications and the needed thermal load of space. This arrangement enables the system to work with a single or binary fluid. The combined system is used for cooling or heating residential or industrial buildings. It is also used for cooling data centers. The novel aspects of the invention are using an electrical compressor and an ejector as a combined electrical-thermal compressor to circulate the working fluid around the cycle and pump the heat from low-temperature reservoirs to a high-temperature reservoir. The concept of an electrical-thermal compressor reduces the compression power by several folds, and hence high performance is attained. Also, integrating OHP with the evaporator eliminates the convective heat transfer resistance between the indoor air and the evaporator's surface.

Moreover, the combined system has a feature to operate using binary fluid, which is selected based on the ambient conditions of the location where the system is installed. This feature allows the system to work at high performance regardless of the local climate conditions. This invention reduces energy consumption by at least a factor of three compared to the traditional heat pump. Energy saving associated with the invented system could be further improved by optimizing the design of ejector geometry according to the operating working fluid.

An aspect of the present disclosure is a heat pump system for cooling or heating utilizing a refrigerant that includes a compressor, an ejector in fluid communication with an output of the compressor, a condenser in fluid communication with an output of the ejector, a throttling valve in fluid communication with an output of the condenser, an evaporator having an input in fluid communication with an output of the throttling valve and an output in fluid communication with an input of the ejector and an input of the compressor.

Another aspect of the present disclosure is a three-way valve that is in fluid communication with an output of the evaporator and splits a fluid stream into an input of the compressor and into an input of the ejector.

Yet another aspect of the present disclosure is a mass flow rate that corresponds to energy across the heat pump system where the compressor handles part of the mass flow rate while the ejector handles a remainder of the mass flow rate while the evaporator and the condenser handles an entire mass flow rate resulting in an increase in the cooling and heating efficiency of the cycle.

Another feature of the present disclosure is the compressor draws and compresses the refrigerant that exits the evaporator that is used to power the ejector, as a primary fluid of the ejector, and flows through the ejector, where its pressure decreases and hence extracts vapor from the evaporator, which is the secondary fluid of the ejector, to achieve a refrigeration capacity.

Yet another aspect of the present disclosure is the primary fluid and the secondary fluid of the ejector mix and travel to the condenser to reject heat to air or water that is used to facilitate the operation of the condenser and then leaves the condenser as a saturated liquid that is throttled by the throttling valve and then passes to the evaporator according to a corresponding evaporator pressure to remove the thermal load from the space.

Still, yet another feature of the present disclosure is useful cooling energy from this heat pump system correlates to the evaporator's capacity, while the useful heating energy correlates to the condenser's capacity.

Another feature of the present disclosure is an evaporator is a combination evaporator-OHP for cooling a data center having servers and are in direct contact therewith.

Still another aspect of the present disclosure is a plurality of combination evaporator-OHPs for cooling a plurality of servers where the plurality of combination evaporator-OHPs each include an adjacent wicking structure that is adjacent to a vapor channel and a liquid channel.

A further feature of the disclosure is a first tank that circulates liquid refrigerant through the liquid channel and back to the first tank.

Still, another feature of the present disclosure is a second tank located between the compressor and the ejector, wherein the vapor channel provides low-pressure refrigerant to both an input of the ejector and an input of the compressor, wherein an output of the ejector is in fluid communication with an input of the condenser and the output of the condenser is in fluid communication with the input of the throttle valve and the output of the throttle valve is in fluid communication with the first tank to provide liquid refrigerant to the first tank.

Still yet another feature of the present disclosure is a first tank that circulates the liquid refrigerant through the liquid channel and back to the first tank and a second tank located between the compressor and the ejector, wherein a vapor channel provides low-pressure refrigerant to both an input of the ejector and an input of the compressor, wherein an output of the ejector is in fluid communication with an input of the condenser and the output of the condenser is in fluid communication with the input of the throttle valve and the output of the throttle valve is in fluid communication with the first tank to provide liquid refrigerant to the first tank.

Another aspect of the present disclosure is a heat pump system for cooling or heating utilizing a binary refrigerant that includes a compressor, an ejector in fluid communication with an output of the compressor, a condenser in fluid communication with an output of the ejector, a first throttling valve in fluid communication with a first output of the condenser, a first evaporator having an input in fluid communication with an output of the first throttling valve, wherein the output of the first evaporator is in fluid communication with an input of the ejector, a second throttling valve in fluid communication with a first input that is in fluid communication with an output of the first throttling valve, and a second evaporator having an input in fluid communication with an output of the second throttling valve, wherein the output of the second evaporator is in fluid communication with an input of the compressor.

An additional feature of the disclosure is the first evaporator is a first plurality of combination evaporator-OHPs for cooling a data center having servers and are in direct contact therewith and the second evaporator is a second plurality of combination evaporator-ejector-OHPs for cooling a data center having servers and are in direct contact therewith.

Yet another feature of the method of the present disclosure is the first plurality of combination evaporator-OHPs and the second plurality of combination evaporator-ejector OHPs for cooling a plurality of servers where the first plurality of combination evaporator-OHPs and the second plurality of combination evaporator-ejector OHPs each include an adjacent wicking structure that is adjacent to a vapor channel and a liquid channel.

It still another feature of the method of the present disclosure is a first tank that circulates liquid refrigerant through the liquid channel and back to the first tank and a second tank located between the compressor and the ejector, wherein the vapor channel provides refrigerant at a first low-pressure state from the first plurality of combination evaporator-OHPs to the input of the ejector and provides refrigerant at a second low-pressure state from the second plurality of combination evaporator-OHPs to the input of the ejector, wherein an output of the ejector is in fluid communication with an input of the condenser and the output of the condenser is in fluid communication with the input of the throttle valve and the output of the throttle valve is in fluid communication with the first tank to provide liquid refrigerant to the first tank.

It is still yet another feature of the method of the present disclosure is a separator in fluid communication with an output of the condenser and the input of the first throttle valve and the second throttle valve, wherein the first evaporator is a high temperature evaporator, and the second evaporator is a low-temperature evaporator where the refrigerant is a binary fluid.

It is yet another feature of the method of the present disclosure is a method of utilizing a heat pump system for cooling or heating utilizing a refrigerant that includes transferring the compressed refrigerant to an ejector in fluid communication with an output of the compressor, utilizing a condenser in fluid communication with an output of the ejector to either release or collect heat, and utilizing at least one throttling valve and at least one evaporator in fluid communication with an output of the condenser, an input of the ejector, and an input of the compressor.

In still yet another aspect of the present disclosure includes utilizing a three-way valve that is in fluid communication with an output of the evaporator and splits a fluid stream into an input of the compressor and into an input of the ejector.

It is a further object, feature, and/or advantage of the present disclosure includes utilizing a first throttling valve and a second throttling valve and a first evaporator and a second evaporator with a binary fluid, wherein the first throttling valve is in fluid communication with a first output of the condenser and the input of the first throttling valve and the input of the second evaporator and the output of the first evaporator is in fluid communication with an input of the ejector and the output of the second evaporator is in fluid communication with an input of the compressor.

It is still yet a further object, feature, and/or advantage of the present disclosure includes utilizing a first plurality of combination evaporator-OHPs and the second plurality of combination evaporator-ejector OHPs for cooling a plurality of servers where the first plurality of combination evaporator-OHPs and the second plurality of combination evaporator-OHPs each include an adjacent wicking structure that is adjacent to a vapor channel and a liquid channel a first tank that circulates liquid refrigerant through the liquid channel and back to the first tank and a second tank located between the compressor and the ejector, wherein the vapor channel provides refrigerant at a first low pressure state from the first plurality of combination evaporator-OHPs to the input of the ejector and provides refrigerant at a second low pressure state from the second plurality of combination evaporator-OHPs to the input of the ejector, wherein an output of the ejector is in fluid communication with an input of the condenser and the output of the condenser is in fluid communication with the input of the throttle valve and the output of the throttle valve is in fluid communication with the first tank to provide liquid refrigerant to the first tank.

These and/or other objects, features, advantages, aspects, and/or embodiments will become apparent to those skilled in the art after reviewing the following brief and detailed descriptions of the drawings. The present disclosure encompasses (a) combinations of disclosed aspects and/or embodiments and/or (b) reasonable modifications not shown or described. These and/or other objects, features, advantages, aspects, and/or embodiments will become apparent to those skilled in the art after reviewing the following brief and detailed descriptions of the drawings. The present disclosure encompasses (a) combinations of disclosed aspects and/or embodiments and/or (b) reasonable modifications not shown or described.

BRIEF DESCRIPTION OF THE DRAWINGS

Several embodiments in which the present disclosure can be practiced are illustrated and described in detail, wherein like reference characters represent like components throughout the several views. The drawings are presented for exemplary purposes and may not be to scale unless otherwise indicated.

An artisan of ordinary skill in the art need not view, within isolated figure(s), the near infinite distinct combinations of features described in the following detailed description to facilitate an understanding of the present disclosure.

DETAILED DESCRIPTION

The present disclosure is not to be limited to that described herein. Mechanical, electrical, chemical, procedural, and/or other changes can be made without departing from the spirit and scope of the present disclosure. No features shown or described are essential to permit basic operation of the present disclosure unless otherwise indicated.

Figure 1:
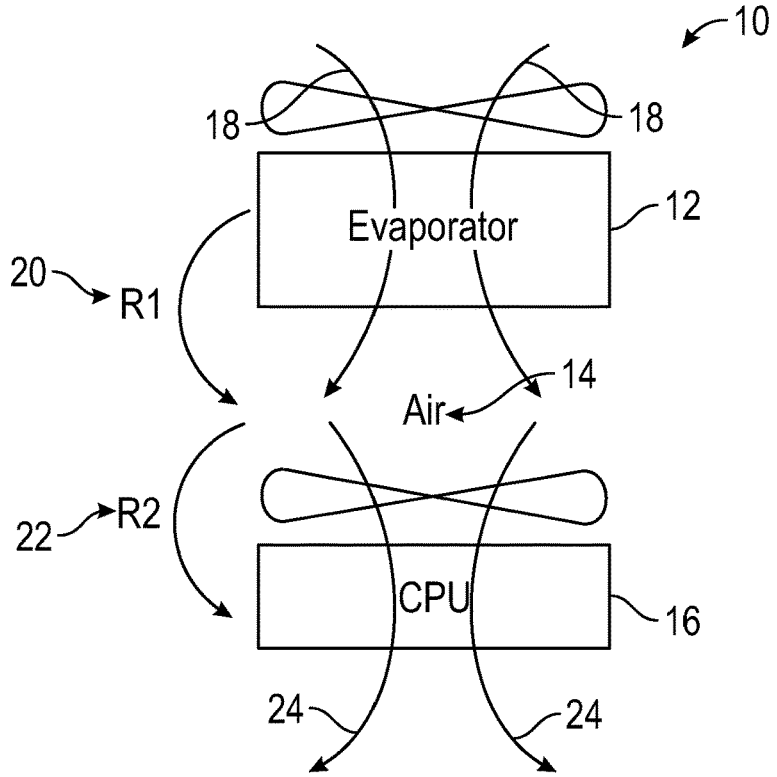
FIG. 1 (Prior Art)
FIG. 1 is a schematic of convective resistances in a standard CPU cooling system found in the prior art.
Figure 2:
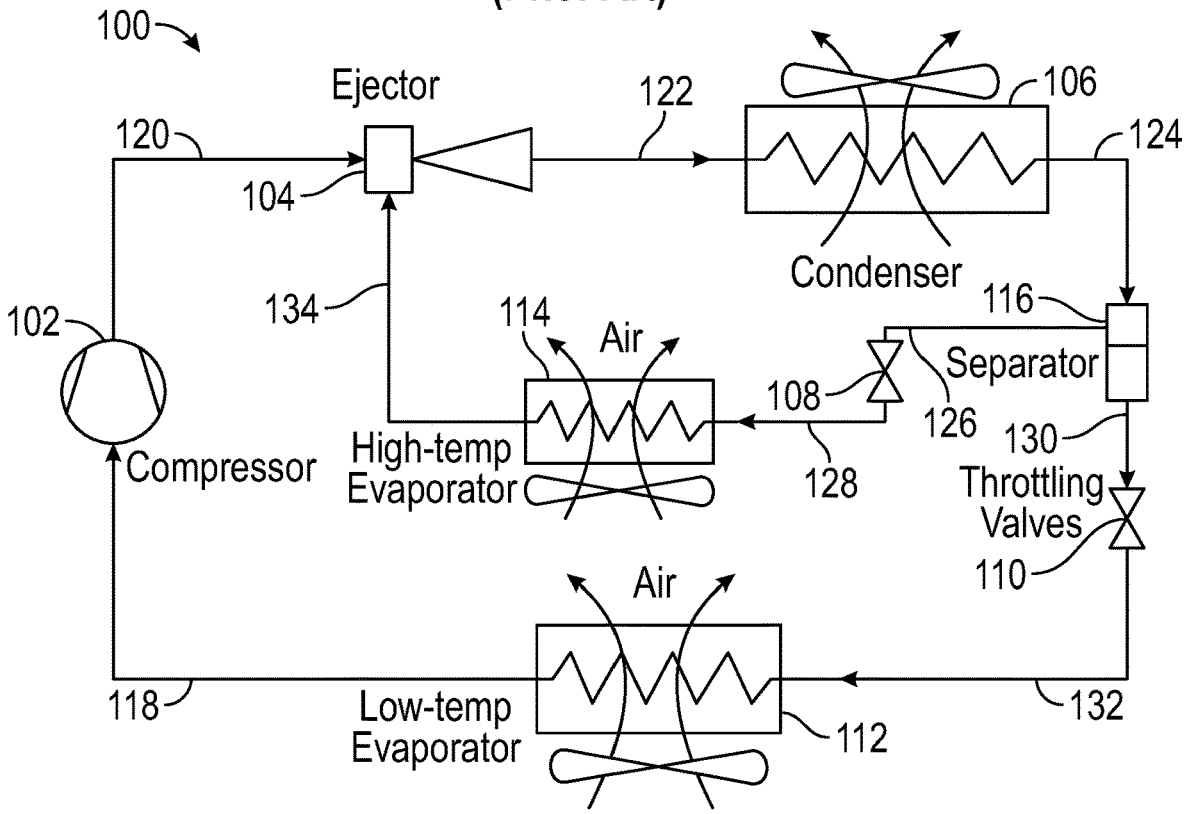
FIG. 2 is a schematic view of a compressor-ejector heat pump with two evaporators.

Referring now to FIG. 2, the arrangement of the novel heat pump for cooling or heating industrial and residential buildings is generally indicated by the numeral 100. The cycle has a compressor 102, an ejector 104, a condenser 106, a first throttling valve 108 and a second throttling valve 110, a first evaporator (low temperature) 112 and a second evaporator (high temperature)114, and a liquid separator 116.

A compressor is defined as a device that packs molecules in the gas-based refrigerant tightly together, a process that raises both the temperature and pressure of the refrigerant. A condenser is the outdoor portion of an air conditioner or heat pump that either releases or collects heat, depending on the time of the year. An ejector is defined as utilizing as a principle of operation based on the Venturi effect of a converging-diverging nozzle to convert the pressure energy of a motive fluid, functioning as a primary flow, to kinetic energy to entrain a suction fluid, functioning as a secondary flow, and then recompress the mixed fluids by converting kinetic energy back into pressure energy Ejectors are thermally activated static compressors and consist of a nozzle (a primary convergent-divergent nozzle) embedded in a main, generally cylindrical, body where the compression effect results from the interaction of the two fluid streams. The motive stream is at high pressure and is produced in a generator using a heat source. This heat source can come from low-grade temperature heat. Therefore, ejectors thus have the advantage that they can be driven with waste heat and used as heat pumps in appropriate cycles to produce heat upgrading, cooling, or refrigeration effects, provided as long as a thermal source is available.

The throttle valve is a mechanical device whose function is to regulate and maintain the downstream pressure so that the inlet conditions for the expansion are constant. It does this by introducing a flow restriction, inducing a significant localized pressure drop in the refrigerant. The evaporator holds the chilled refrigerant that the compressor moves into it. As the air from the blower fan moves over the coil, the cold refrigerant removes the heat from your home's air. The refrigerant becomes warmer and travels to the condenser coil outdoors. With a heat pump, the process reverses in the winter, and the evaporator coil expels heat from the refrigerant into your home instead of absorbing it and taking it outdoors. A separator is utilized when utilizing a binary refrigerate to separate out the two fluids.

FIG. 2 illustrates the principle of operation of an ejector-based heat pump system. The compressor 102 draws and compresses the refrigerant from a first state 118 that exits the first evaporator (low temperature) 112 to a second state 120, which is used to power the ejector 104 and operates as the primary fluid for the ejector 104. A stream in the second state 120 flows through the ejector 104, where its pressure decreases and hence sucks vapor from the second evaporator (high temperature)114 that is in a ninth state 134, which is the secondary fluid of the ejector 104 to achieve a refrigeration capacity. The streams from the second state 120 and the ninth state 134 mix in the ejector 104, and a stream exits in a third state 122 to the condenser 106 to reject heat to air or water that is used to facilitate the operation of the condenser 104. The stream in a fourth state 124 leaves the condenser 106 as a saturated liquid and goes to a separator 116. Note that the separator 116 is installed if a binary fluid is used as a refrigerate. Each saturated liquid in the separator 116 is throttled to the corresponding evaporator pressure.

Therefore, the stream at a fifth state 126 exiting the separator 116 passes into a first throttling valve 108 and emerges in a sixth state 128 before entering the second evaporator (high temperature)114 that is connected to the ejector 104 via a stream in a ninth state 134.

Moreover, the stream at a seventh state 130 exiting the separator 116 passes into a second throttling valve 110 and emerges in an eighth state 132 before entering the first evaporator (low temperature) 112 that is connected to the compressor 102 via a stream in the first state 118.

These streams from the sixth state 128 and the eighth state 132 evaporate in the Second evaporator (high temperature) 114 and the first evaporator (low temperature) 112, respectively, and remove the thermal load from the space. The useful cooling energy from this system is the capacity of the first evaporator (low temperature) 112 and the second evaporator (high temperature) 114, while the useful heating energy is the capacity of the condenser 106.

This configuration has many advantages and features. The ejector 104 is coupled with a compressor 102 to reduce its energy consumption. So, the ejector 104 operates like a compression booster. On the other hand, the stream exits the compressor 102 at high pressure and temperature in the second state 120 and is utilized to power the ejector 104 and indirectly facilitates the operation of the second evaporator (high temperature) 114.

Using two evaporators 112 and 114 to handle the cooling load allows for decoupling between the sensible and latent heat load and achieving higher efficiency. The high-temperature evaporator 114 is used to handle the sensible load, while the low-temperature evaporator is used to handle the latent heat.

In addition, this arrangement allows the system 100 to operate using single or binary fluid and adds flexibility in choosing the best option to achieve higher efficiency based on the required load and ambient conditions. For the single fluid mode, the separator 116 is not needed. For the binary fluid mode, the separator 116 separates two different fluids.

This configuration can be used for heating purposes by harvesting the heat rejected in the condenser 106, while binary fluid can be used to achieve high efficiency.

Figure 3:
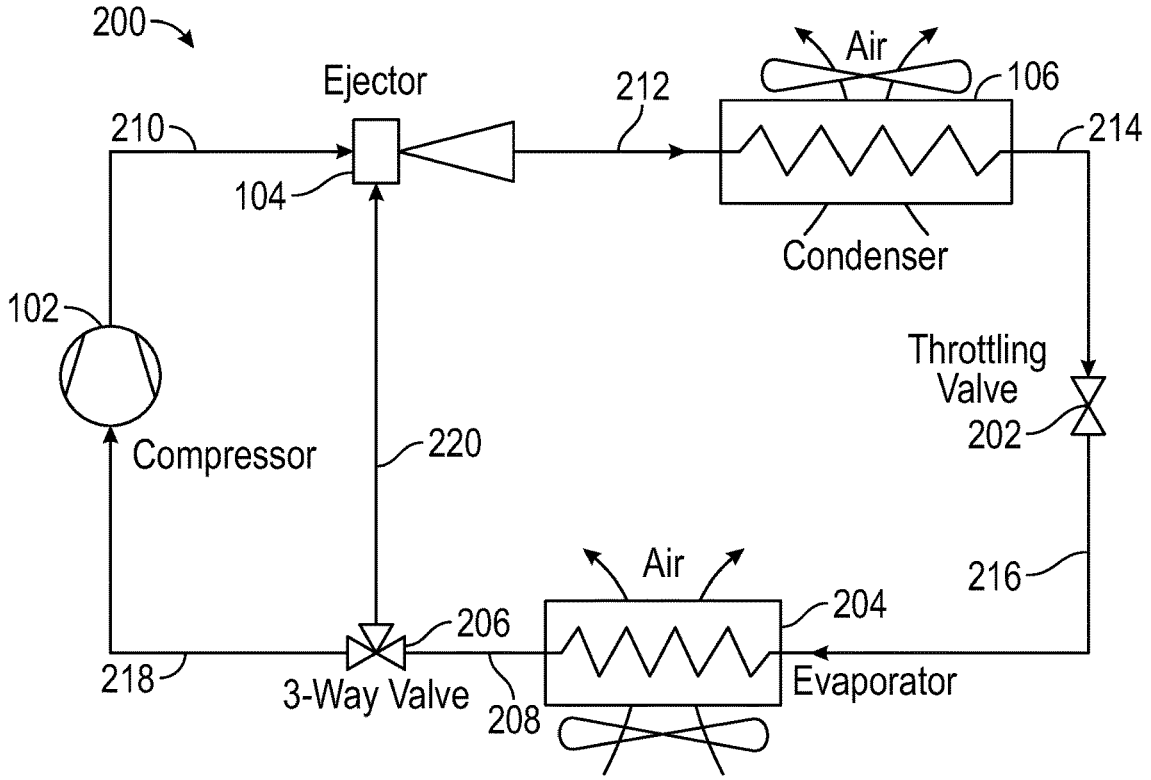
FIG. 3 is a schematic view of a compressor-ejector heat pump with one evaporator.

A second embodiment is generally indicated by the numeral 200 in FIG. 3, which is another configuration from the invented heat pump is disclosed, which is used when the sensible heat factor of space (the ratio between the sensible heat load to the total heat load) is very high or very low. In other words, when the sensible heat is much higher than the latent load or vice versa, using two evaporators might not be beneficial from an economic point of view. FIG. 3 shows the invented heat pump operating with one evaporator 204. It can be seen that the separator 116 that is used in FIG. 2 is removed, and the two evaporators 112 and 114 are combined into one evaporator 204. Reducing the number of components decreases the capital cost of the system. A three-way valve 206 is used in this cycle to split the stream that exits the evaporator 204, indicated as a first state 208, into two streams, with a sixth state 218 is drawn by the compressor 102 while the other stream in a seventh state 220 works as a secondary fluid for the ejector 104. The stream leaving the compressor 102 is a second state 210, the stream leaving the ejector 104 is a third state 212, the stream leaving the condenser 106 is a fourth state 214, while the stream leaving the throttling valve 202 and entering the evaporator 204 is a fifth state 218.

In the conventional VCC, each component in the cycle handles the same amount of mass flow rate. For this invented configuration, the compressor 102 handles part of the mass flow rate while the ejector 104 handles the remainder. At the same time, the evaporator 204 and condenser 106 handle the entire mass flow rate. The mass flow rate corresponds to energy across the component. Therefore, the energy required to run the compressor 102 reduces, leading to an increase in the cooling and heating efficiency of the cycle.

The above two embodiments can be adapted to be a combined compressor-OHPs heat pump for the data centers. As previously mentioned, it is not efficient to use VCC for cooling data centers due to the energy loss in the convective heat resistance between the evaporator, air, and servers or CPU. In a third embodiment, the heat pump is coupled with Oscillating Heat Pipes (OHPs) to take advantage of the high performance of OHPs in transferring the energy and completely eliminate the convective heat resistances. This allows the evaporator(s) of the heat pump to work at a relatively higher temperature. It is well-established that increasing the evaporator temperature raises the cycle's efficiency.

Figure 4:
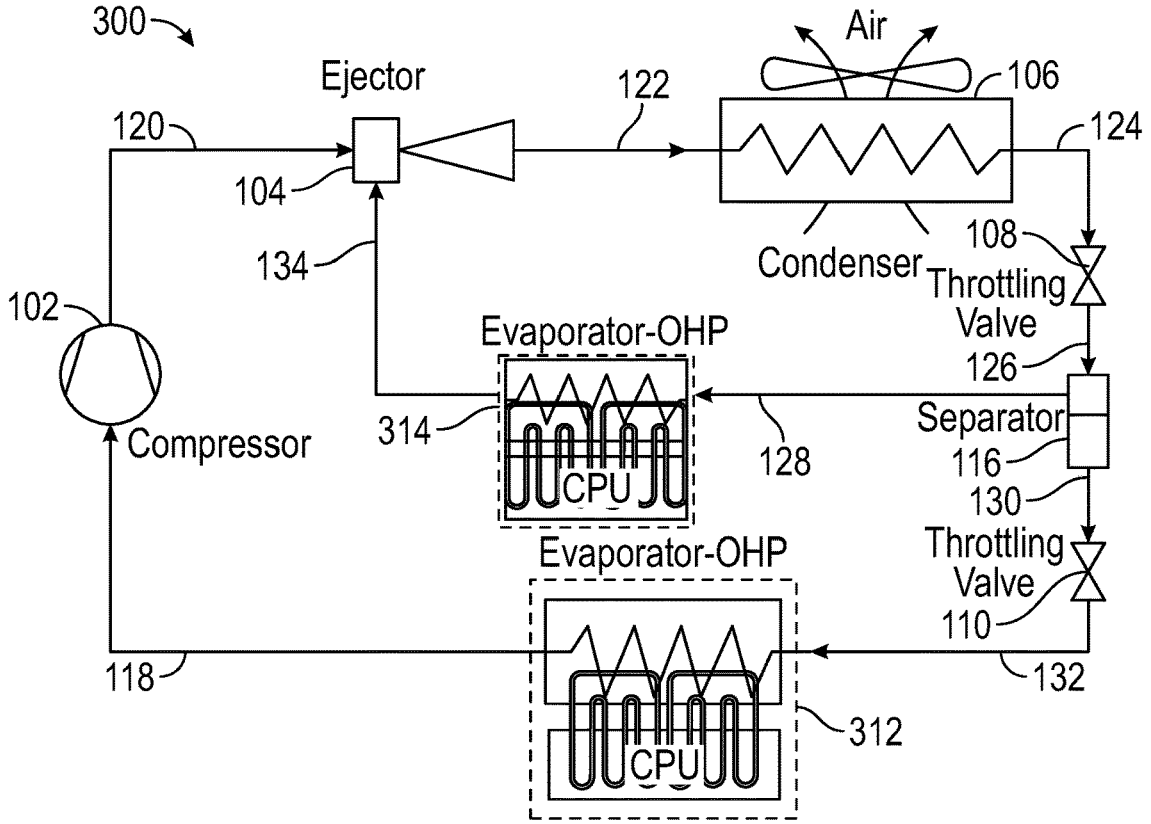
FIG. 4 is a schematic view of a compressor-ejector heat pump coupled with OHPs using two evaporators.

Referring now to FIG. 4, this schematic is generally indicated by the numeral 300 is identical to that shown in FIG. 2 with the exception that there is now a combination of first evaporator-OHP indicated by numeral 312 instead of the first evaporator (low temperature) 112 by itself and a second evaporator-OHP indicated by numeral 314 instead of just the second evaporator (high temperature) 114 by itself.

The temperature of the low-evaporator temperature for HVAC is 30° C. (because the OHP is directly contacting CPUs), which is the high-temperature-evaporator temperature for the ejector as well. The condenser temperature is 35° C. (which is the ambient air temperature).

The compression ratio is assumed to be three to test different refrigerants. The cooling coefficient of performance (COP) of the proposed heat pump is calculated as:

$$COP = \frac{\dot{Q}_{LTE} + \dot{Q}_{HTE}}{\dot{W}_c} \qquad \text{Equation 1}$$

where $\dot{Q}_{LTE}$ is the capacity of low-temperature evaporator, $\dot{Q}_{HTE}$ is the capacity of high-temperature evaporator, and $\dot{W}_c$ is the compressor power.

The COP of a standalone vapor compression cycle is calculated using an evaporation temperature of 5° C. and a condensing temperature of 35° C. (the same as the invented heat pump). The improvement factor is calculated as the ratio between the two COPs. Different refrigerants (R1234yf, R123, and R245fa) are tested at the same operating conditions. The improvement factor is always more than 2.0.

Referring now to the states in FIG. 4, illustrative, but nonlimiting examples of values of this design include a coefficient of performance (COP) to be 21.42 with an R245f refrigerant. The coefficient of performance (COP) for a vapor compression cycle is 8.013. ER is equal to 1.166. At the third state 122, the temperature is 51.4° C., and $X_4$ is 1.02. The temperature at the condenser 106 is 48° C. with the pressure at 322.6 kPa. The temperature at the second state 120 is 70.86° C., and the pressure is 624 kPa. and $X_2$ is 0.971. At the fourth state 124, $m_5$ is 2.166 kg/second. At the sixth state 128, pressure is 249.6 kPa. and temperature is 40° C. Upon leaving the second evaporator-OHP 312, the temperature is 40° C., and the pressure is 249.6 kPa at the first state 118.

Illustrative, but nonlimiting examples of values of this design include a coefficient of performance (COP) of 21.45 with an R123 refrigerant. ER is equal to 1.181. The coefficient of performance (COP) for a vapor compression cycle is 8.268. At the third state 122, the temperature is 51.92° C., and $X_4$ is 1.018. The temperature at the condenser 106 is 48° C. with the pressure at 200 kPa. The temperature at the second state 120 is 70.87° C., and the pressure is 386.6 kPa. $X_2$ is 0.9821. At the fourth state 124, $m_5$ is 2.181 kg/second. At the sixth state 128, pressure is 154.7 kPa. at 40° C. Upon leaving the second evaporator-OHP 312, the temperature is 40° C., and the pressure is 154.7 kPa.

Illustrative, but nonlimiting examples of values of this design include a coefficient of performance (COP) of 14.57 with an R1234yf refrigerant. ER is equal to 1.386. The coefficient of performance (COP) for a vapor compression cycle is 6.402. At the condenser 106, the temperature is 35° C. The improvement factor is 2.276. At the third state 122, $n_m$=0.95. At the second state 120, the temperature is 78.98° C. At the sixth state 128, the temperature is 30° C., and the pressure is 783.5 kPa. At the first state 118, the temperature is 30° C. with a pressure of 783.5 kPa.

Illustrative, but nonlimiting examples of values of this design include a coefficient of performance (COP) of 17.9 with an R123 refrigerant. ER is equal to 1.319. The coefficient of performance (COP) for a vapor compression cycle is 6.919. At the condenser 106, the temperature is 35° C. The improvement factor is 2.586. At the third state 122, $n_m$=0.95. At the second state 120, the temperature is 65.04° C. At the sixth state 128, the temperature is 30° C., and the pressure is 109.7 kPa. At the first state 118, the temperature is 30° C. with a pressure of 109.7 kPa.

Illustrative, but nonlimiting examples of values of this design include a coefficient of performance (COP) of 17.93 with an R245fa refrigerant. ER is equal to 1.297. The coefficient of performance (COP) for a vapor compression cycle is 17.93. The improvement factor is 2.626. At the third state 122, $n_m$=0.95. At the second state 120, the temperature is 64.97° C. At the condenser 106, the temperature is 35° C. At the sixth state 128, the temperature is 30° C., and the pressure is 177.2 kPa. At the first state 118, the temperature is 30° C. with a pressure of 177.2 kPa.

For house-HVAC: The low-evaporator temperature will handle the latent heat, and its temperature is set as 5° C., while the high-evaporator temperature will handle the sensible heat and its temperature is set as 15° C. These are the typical conditions for separate sensible and latent cooling systems. The condenser temperature is 35° C. (which is the ambient air temperature). The cooling COP of the proposed heat pump is calculated as below. The COP of a standalone vapor compression cycle is calculated using an evaporation temperature of 5° C. and a condensing temperature of 35° C. (the same as the invented heat pump). Using Ammonia (R717) as a working fluid, the invented system could achieve an improvement of the COP by 50%.

Illustrative, but nonlimiting examples of values of this design include a coefficient of performance (COP) of 10.56 with an R717 refrigerant. ER is equal to 0.4483. The coefficient of performance (COP) for a vapor compression cycle is 6.876. The improvement factor is 1.536. At the third state 122, $n_m$=0.95. At the second state 120, the temperature is 78.66° C. At the condenser 106, the temperature is 35° C. At the sixth state 128, the temperature is 15° C., and the pressure is 728.8 kPa. At the first state 118, the temperature is 5° C. with a pressure of 516 kPa.

When the working fluid is water (R718), an improvement of more than 3.0 could be achieved. The reason is the pressure ratio of the standalone vapor compression cycle operates between 5 and 35° C. is about 6.5, while the compression ratio of 3.0 is enough to power the invented heat pump. This saves much electricity plus more cooling is provided using two evaporators.

As previously mentioned, using two combined evaporators-OHPs 312 and 314 adds flexibility to the system by controlling the operating conditions and using binary fluids to achieve higher efficiency, as shown in FIG. 4. This system is expected to reduce energy consumption in data centers by at least a factor of three compared to the traditional VCC.

Illustrative, but nonlimiting examples of values of this design include a coefficient of performance (COP) of 23.57 with an R718 refrigerant. ER is equal to 0.927. The coefficient of performance (COP) for a vapor compression cycle is 6.138. The improvement factor is 3.839. At the third state 122, $n_m$=0.95. At the second state 120, the temperature is 108.3° C. and $X_2$=1.067. At the condenser 106, the temperature is 35° C. At the sixth state 128, the temperature is 15° C., and the pressure is 1.706 kPa. At the first state 118, the temperature is 5° C. with a pressure of 0.8725 kPa.

Figure 5:
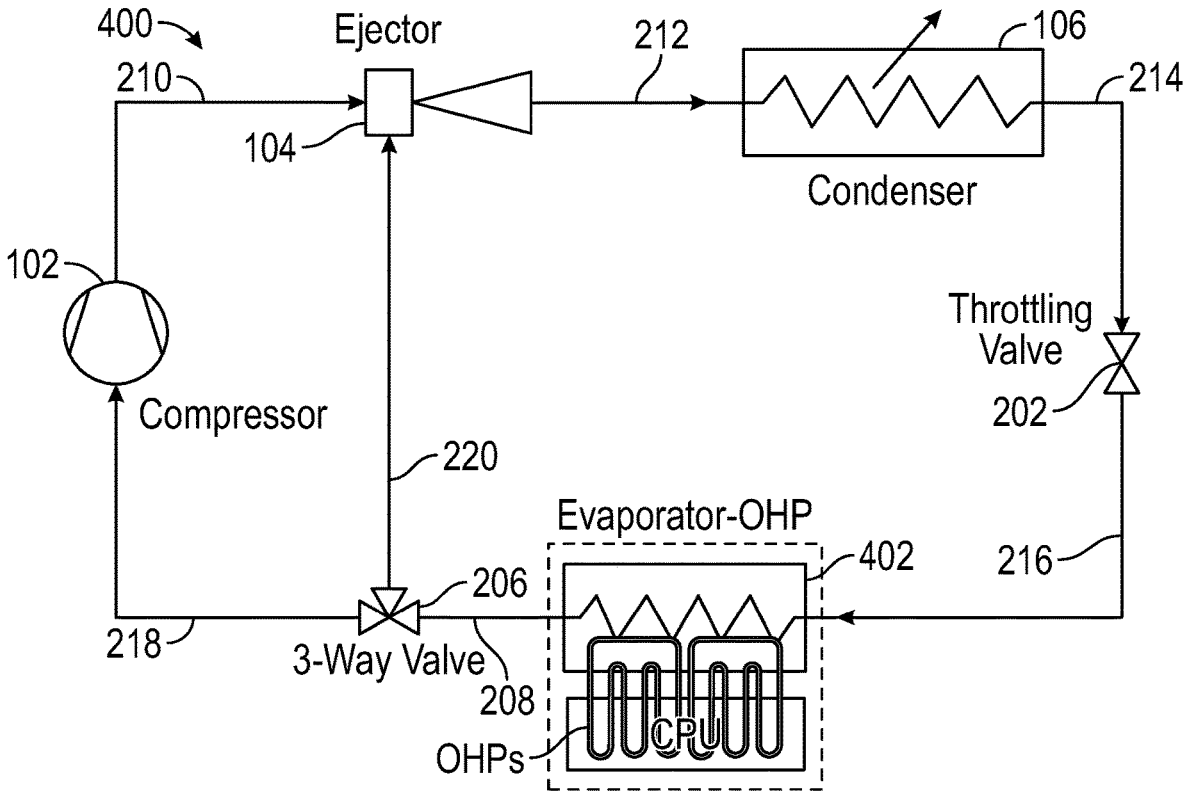
FIG. 5 is a schematic view of a compressor-ejector heat pump coupled with OHPs using one evaporator.

Referring now to FIG. 5, this schematic is generally indicated by the numeral 400, which is identical to that shown in FIG. 3 with the exception that there is now a combination first evaporator-OHP indicated by the numeral 402 instead of the single evaporator 204 by itself.

As referenced previously with respect to FIG. 3, this simple cycle in FIG. 5 is utilized when the sensible heat factor of space (the ratio between the sensible heat load to the total heat load) is very high or very low. In other words, when the sensible heat is much higher than the latent load or vice versa, using two evaporators might not be beneficial from an economic point of view.

Figure 6:
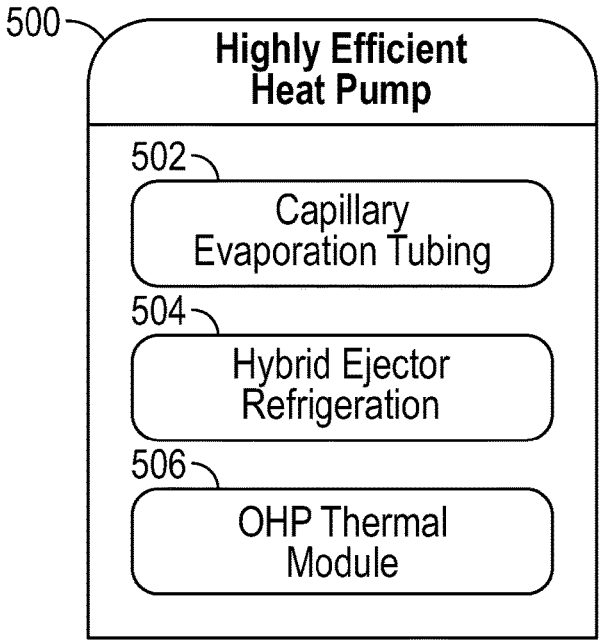
FIG. 6 is a schematic of the basic components of a heat pump system for a data center.

Referring now to FIG. 6, the main components of a highly efficient heat pump for servers and CPUs are generally indicated by the numeral 500. This includes capillary evaporation tubing 502, hybrid ejector refrigeration 504, and OHP thermal modules 506.

Figure 7:
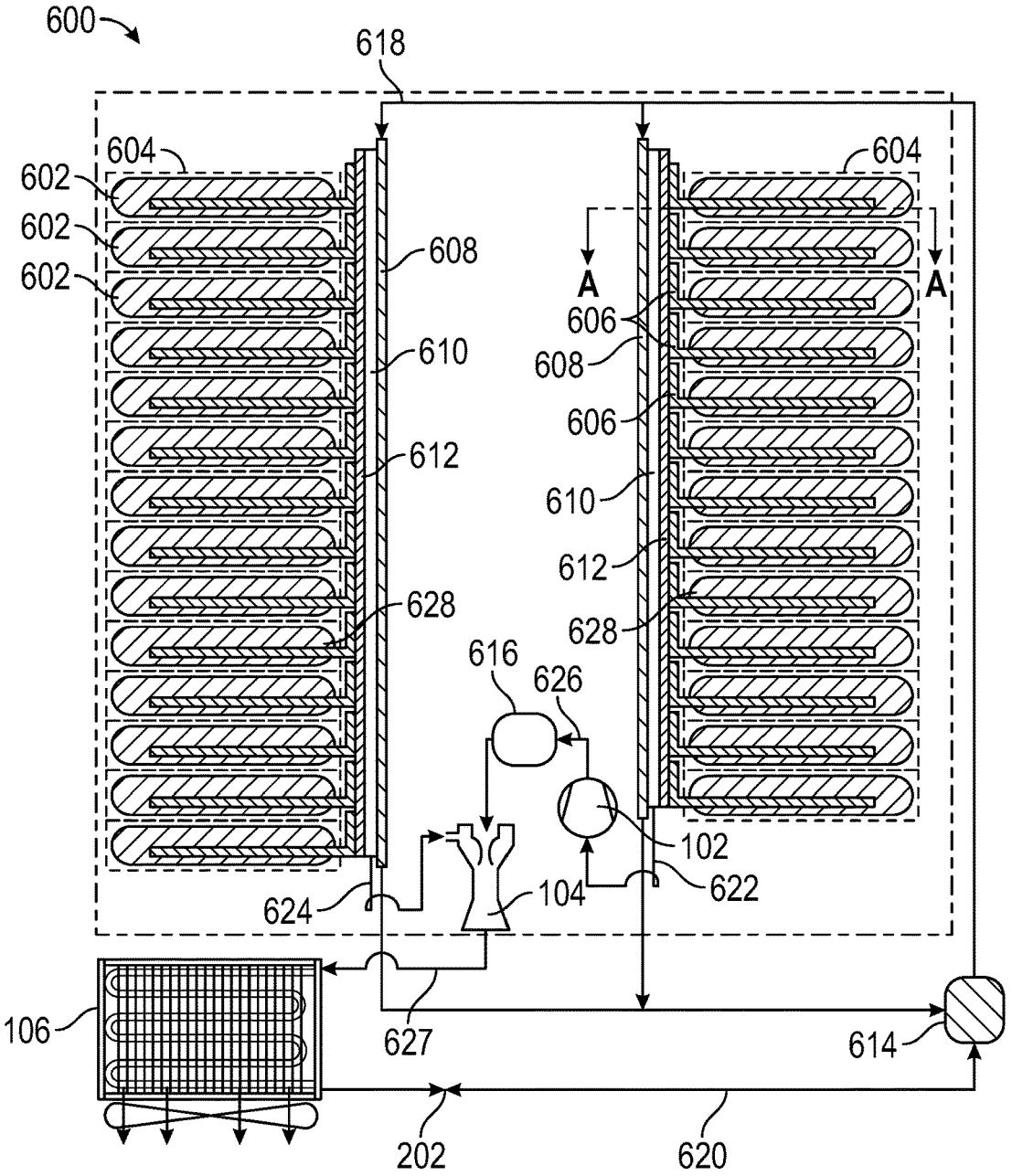
FIG. 7 is a schematic of a data center cooling system of associated compressor-ejector heat pump with multiple OHPs.

This illustrative, but nonlimiting, server and/or CPU cooling system is generally indicated by the numeral 600 in FIG. 7. This includes a compressor 102, an ejector 104, evaporation chambers or evaporators 628, OHP thermal modules 606, and an air-cooled condenser 106. The heat generated from the servers 602 is directly transferred to the evaporation chambers 628, which are the evaporators of the vapor-compression ejector heat pump through an OHP thermal module 606, which is in direct contact with heat sources in the server 602. This direct contact between the condenser sections of the OHP modules 606 and evaporation chambers 628 can eliminate the thermal resistance between heat sinks and the ambient air. The vapor in the evaporation chambers 628 is pumped out and compressed by a compressor 102. The compressed vapor flows into the ejector 104, where a supersonic flow is produced, resulting in a low pressure in the ejector 104 that fluidly connects with the evaporation chambers 628, where capillary and thin-film evaporation takes place, and additional cooling is produced. The refrigerant vapor exiting the ejector 104 brings all the thermal energy from the servers to the air-cooled condenser, where the thermal energy is transferred to the ambient air.

In detail, the refrigerant from the first tank 614 is in first liquid state 618 and goes into the liquid channel 608, providing cooling in the OHP modules 606 before returning to the first tank 614. The vapor channel 610 is located between the liquid channel 608 and the wicking structure 612 and provides refrigerant in a first low-pressure vapor state 622 to the compressor 102 that converts the refrigerant to a first high-pressure state 626 before entering a second tank 616 as the primary stream into the ejector 104 with a secondary stream provided by another vapor channel 610 in a second low vapor pressure state 624. Upon exiting the ejector 104 in a second high-pressure vapor state 627, the refrigerant enters the condenser 106 and then passes into a throttling valve 202 in a second liquid state 620 prior to returning to the first tank 614.

Figure 8:
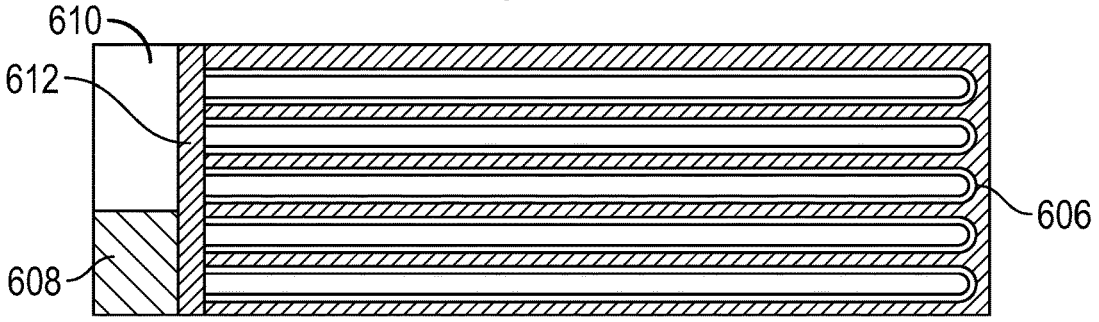
FIG. 8 is a sectional view along Line A-A shown in FIG. 7 showing a wicking structure, a vapor channel, and a liquid channel for an OHP.

Referring now to FIG. 8, a sectional view along line A-A in FIG. 7 shows the relationship of the OHP thermal modules 606 with the vapor channel 610 positioned on top of the liquid channel 608, with the wicking structure 612 operating as a buffer between the OHP thermal module(s) 606 and the layered vapor channel 610 and liquid channel 608.

In summary, the novel aspects of the invention are using an electric compressor and an ejector as a combined electrical-thermal compressor to circulate the working fluid around the cycle and pump the heat from low-temperature reservoirs to a high-temperature reservoir. The concept of an electrical-thermal compressor reduces the compression power by several folds; hence, high performance is attained. Different configurations are disclosed for the invented heat pump to be used for cooling/heating purposes of buildings or for cooling data centers. Two evaporators are used to decouple the latent heat load from the sensible heat load and achieve higher efficiency for cooling or heating buildings. OHPs are integrated with evaporators for cooling data centers to eliminate the convective heat transfer resistances between the indoor air, CPUs, and the evaporator's surface.

Moreover, the combined system has a feature to operate using binary fluid, which is selected based on the ambient conditions of the location where the system is installed. This feature allows the system to work at high performance regardless of the local climate conditions. This invention reduces energy consumption by at least a factor of three compared to the traditional heat pump. Energy saving associated with the invented system could be further improved by optimizing the design of ejector geometry according to the operating working fluid.

From the foregoing, it can be seen that the present disclosure accomplishes at least all of the stated objectives.

LIST OF REFERENCE CHARACTERS

The following table of reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1

| List of Reference Characters | |
|---|---|
| 10 | Current conventional air conditioning (AC) system for CPUs |
| 12 | Evaporator |
| 14 | Cooled air from the evaporator |
| 16 | Processors or CPUS |
| 18 | Air entering the evaporator |
| 20 | Convective heat resistance between the evaporator and air leaving the evaporator |
| 22 | Convective heat resistance between the air leaving the evaporator and the CPUs |
| 24 | Air exiting CPUs after cooling the CPUs |
| 100 | Novel heat pump for cooling or heating industrial and residential buildings |
| 102 | Compressor |
| 104 | Ejector |
| 106 | Condenser |
| 108 | First throttling valve |
| 110 | Second throttling valve |
| 112 | First evaporator (low temperature) |
| 114 | Second evaporator (high temperature) |

TABLE 1-continued

| List of Reference Characters | |
|---|---|
| 116 | Liquid separator |
| 118 | First state |
| 120 | Second state |
| 122 | Third state |
| 124 | Fourth state |
| 126 | Fifth state |
| 128 | Sixth state |
| 130 | Seventh state |
| 132 | Eighth state |
| 134 | Ninth state |
| 200 | Second embodiment of a heat pump is when the ratio between the sensible heat load to the total heat load is very high or very low. |
| 202 | Throttling valve |
| 204 | Evaporator |
| 206 | Three-way valve |
| 208 | First state |
| 210 | Second state |
| 212 | Third state |
| 214 | Fourth state |
| 216 | Fifth state |
| 218 | Sixth state |
| 220 | Seventh state |
| 300 | Heat pump system for the data centers with dual .combination evaporator -OHPs |
| 312 | First combination evaporator-OHP |
| 314 | Second combination evaporator-OHP |
| 400 | Heat pump system for the data centers with a single .combination evaporator-OHPs |
| 402 | Combination evaporator OHP |
| 500 | Highly efficient heat pump for servers or CPUs |
| 502 | Capillary evaporation tubing |
| 504 | Hybrid ejector refrigeration |
| 506 | OHP thermal modules |
| 600 | Illustrative, but nonlimiting, server and/or CPU cooling system |
| 602 | Servers |
| 604 | Racks |
| 606 | OHP thermal modules |
| 608 | Liquid channel |
| 610 | Vapor channel |
| 612 | Wicking structure |
| 614 | First tank |
| 616 | Second tank |
| 618 | First liquid state |
| 620 | Second liquid state |
| 622 | First, the low-pressure vapor state |
| 624 | Second low-pressure vapor state |
| 626 | First, the high-pressure vapor state |
| 627 | Second high-pressure vapor state |
| 628 | Evaporation chambers or evaporators |

Glossary

Unless defined otherwise, all technical and scientific terms used above have the same meaning as commonly understood by one of ordinary skill in the art to which embodiments of the present disclosure pertain.

The terms "a," "an," and "the" include both singular and plural referents.

The term "or" is synonymous with "and/or" and means any one member or combination of members of a particular list.

As used herein, the term "exemplary" refers to an example, an instance, or an illustration, and does not indicate a most preferred embodiment unless otherwise stated.

The term "about" as used herein refers to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variables, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The "invention" is not intended to refer to any single embodiment of the particular invention but encompass all possible embodiments as described in the specification and the claims. The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. A heat pump system utilizing a refrigerant for cooling or heating, comprising:

a compressor;

an ejector in fluid communication with an output of the compressor;

a condenser in fluid communication with an output of the ejector;

a throttling valve in fluid communication with an output of the condenser;

an evaporator having an input in fluid communication with an output of the throttling valve and an output in fluid communication with an input of the ejector and an input of the compressor.

2. The heat pump system utilizing the refrigerant for cooling or heating according to claim 1, further comprising a three-way valve that is in fluid communication with the output of the evaporator and splits a fluid stream into the input of the compressor and into the input of the ejector.

3. The heat pump system utilizing the refrigerant for cooling or heating according to claim 1, wherein an entire mass flow rate corresponds to energy across the heat pump system where the compressor handles a part of the entire mass flow rate while the ejector handles a remainder of the entire mass flow rate while the evaporator and the condenser handle the entire mass flow rate resulting in an increase in the cooling and heating efficiency of the cycle.

4. The heat pump system utilizing the refrigerant for cooling or heating according to claim 1, wherein the compressor draws and compresses the refrigerant that exits the evaporator that is used to power the ejector, as a primary fluid of the ejector, and flows through the ejector, where its pressure decreases and hence extracts vapor from the evaporator, which is the secondary fluid of the ejector, to achieve a refrigeration capacity.

5. The heat pump system utilizing the refrigerant for cooling or heating according to claim 4, wherein the primary fluid and the secondary fluid of the ejector mix and travel to the condenser to reject heat to air or water that is used to facilitate the operation of the condenser and then leaves the condenser as a saturated liquid that is throttled by the throttling valve and then passes to the evaporator according to a corresponding evaporator pressure to remove a thermal load from a space.

6. The heat pump system utilizing the refrigerant for cooling or heating according to claim 1, wherein useful cooling energy from this heat pump system correlates to the evaporator's capacity, while the useful heating energy correlates to the condenser's capacity.

7. The heat pump system utilizing the refrigerant for cooling or heating according to claim 1, wherein the evaporator is a combination evaporator-oscillating heat pipe (OHP) for cooling a data center having servers and are in direct contact therewith.

8. The heat pump system utilizing the refrigerant for cooling or heating according to claim 7, further comprising a plurality of combination evaporator-OHPs for cooling a plurality of the servers where the plurality of combination evaporator-OHPs each include an adjacent wicking structure that is adjacent to a vapor channel and a liquid channel.

9. The heat pump system utilizing the refrigerant for cooling or heating according to claim 8, further comprising a first tank that circulates liquid refrigerant through the liquid channel and back to the first tank.

10. The heat pump system utilizing the refrigerant for cooling or heating according to claim 9, further comprising a second tank located between the compressor and the ejector, wherein the vapor channel provides low-pressure refrigerant to both the input of the ejector and the input of the compressor, wherein the output of the ejector is in fluid communication with an input of the condenser and the output of the condenser is in fluid communication with an input of the throttling valve and the output of the throttling valve is in fluid communication with the first tank to provide liquid refrigerant to the first tank.

11. The heat pump system utilizing the refrigerant for cooling or heating according to claim 8, further comprising a first tank that circulates liquid refrigerant through the liquid channel and back to the first tank and a second tank located between the compressor and the ejector, wherein a vapor channel provides low-pressure refrigerant to both the input of the ejector and the input of the compressor, wherein the output of the ejector is in fluid communication with an input of the condenser and the output of the condenser is in fluid communication with an input of the throttling valve and the output of the throttling valve is in fluid communication with the first tank to provide liquid refrigerant to the first tank.

12. A heat pump system utilizing a binary refrigerant for cooling or heating, comprising:

a compressor;

an ejector in fluid communication with an output of the compressor;

a condenser in fluid communication with an output of the ejector;

a first throttling valve in fluid communication with a first output of the condenser;

a first evaporator having an input in fluid communication with an output of the first throttling valve, wherein an output of the first evaporator is in fluid communication with an input of the ejector;

a second throttling valve in fluid communication with a first input that is in fluid communication with the output of the first throttling valve; and a second evaporator having an input in fluid communication with an output of the second throttling valve, wherein an output of the second evaporator is in fluid communication with an input of the compressor.

13. The heat pump system utilizing the binary refrigerant for cooling or heating according to claim 12, wherein the first evaporator is a first plurality of combination evaporator-OHPs for cooling a first data center having servers and are in direct contact therewith and the second evaporator is a second plurality of combination evaporator-ejector-OHPs for cooling a second data center having servers and are in direct contact therewith.

14. The heat pump system utilizing the binary refrigerant for cooling or heating according to claim 13, wherein the first plurality of combination evaporator-OHPs and the second plurality of combination evaporator-ejector OHPs each include an adjacent wicking structure that is adjacent to a vapor channel and a liquid channel.

15. The heat pump system utilizing the binary refrigerant for cooling or heating according to claim 14, further comprising a first tank that circulates liquid refrigerant through the liquid channel and back to the first tank and a second tank located between the compressor and the ejector, wherein the vapor channel provides refrigerant at a first low-pressure state from the first plurality of combination evaporator-OHPs to the input of the ejector and provides refrigerant at a second low-pressure state from the second plurality of combination evaporator-OHPs to the input of the ejector, wherein the output of the ejector is in fluid communication with an input of the condenser and the first output of the condenser is in fluid communication with an input of the first throttling valve and the output of the first throttling valve is in fluid communication with the first tank to provide liquid refrigerant to the first tank.

16. The heat pump system utilizing the binary refrigerant for cooling or heating according to claim 12, further comprising a separator in fluid communication with the first output of the condenser and the input of the first throttling valve and the second throttling valve, wherein the first evaporator is a high temperature evaporator, and the second evaporator is a low-temperature evaporator.

17. A method for using a heat pump system utilizing a refrigerant for cooling or heating, comprising:

transferring a compressed refrigerant to an ejector in fluid communication with an output of a compressor;

utilizing a condenser in fluid communication with an output of the ejector to either release or collect heat;

utilizing at least one throttling valve and at least one evaporator in fluid communication with an output of the condenser, an input of the ejector, and an input of the compressor; and utilizing a three-way valve that is in fluid communication with an output of the at least one evaporator and splits a fluid stream into the input of the compressor and into the input of the ejector.

18. The method for using a heat pump system utilizing a refrigerant for cooling or heating according to claim 17, wherein the refrigerant comprises a binary fluid, wherein the at least one throttling valve comprises a first throttling valve and a second throttling valve and the at least one evaporator comprises a first evaporator and a second evaporator, wherein the first throttling valve is in fluid communication with the output of the condenser and an input of the first throttling valve and an input of the second evaporator and an output of the first evaporator is in fluid communication with the input of the ejector and an output of the second evaporator is in fluid communication with the input of the compressor.

19. The method for using a heat pump system utilizing a refrigerant for cooling or heating according to claim 17, wherein the at least one evaporator comprises a first plurality of combination evaporator-OHPs and a second plurality of combination evaporator-ejector OHPs for cooling a plurality of servers where the first plurality of combination evaporator-OHPs and the second plurality of combination evaporator-OHPs each include an adjacent wicking structure that is adjacent to a vapor channel and a liquid channel, and further comprising a first tank that circulates liquid refrigerant through the liquid channel and back to the first tank and a second tank located between the compressor and the ejector, wherein the vapor channel provides refrigerant at a first low pressure state from the first plurality of combination evaporator-OHPs to the input of the ejector and provides refrigerant at a second low pressure state from the second plurality of combination evaporator-OHPs to the input of the ejector, wherein the output of the ejector is in fluid communication with an input of the condenser and the output of the condenser is in fluid communication with an input of the at least one throttling valve and an output of the at least one throttling valve is in fluid communication with the first tank to provide liquid refrigerant to the first tank.

* * * * *